US006102819A

United States Patent [19]

Christian et al.

[11] Patent Number: 6,102,819

[45] Date of Patent: Aug. 15, 2000

[54] APPARATUS AND METHOD FOR REMOVING A REPLACEABLE HOCKEY STICK BLADE FROM A HANDLE

[75] Inventors: William D. Christian; Roger A. Christian, both of Warroad, Minn.

[73] Assignee: Christian Brothers, Inc., Warroad, Minn.

[21] Appl. No.: 08/915,789

[22] Filed: Aug. 21, 1997

Related U.S. Application Data

[60] Provisional application No. 60/023,448, Aug. 22, 1996.

[51] Int. Cl.[7] ..... A63B 59/14

[52] U.S. Cl. ..... 473/563

[58] Field of Search ..... 473/563, 560; 81/167

[56] References Cited

U.S. PATENT DOCUMENTS 3,578,307 5/1971 Lock ..... 81/167
5,690,850 11/1997 Anderson ..... 473/563

*Primary Examiner*—Mark S. Graham
*Attorney, Agent, or Firm*—Dorsey & Whitney LLP

[57] ABSTRACT

An apparatus and method usable with a conventional door or other support member for removing a replaceable hockey stick blade from the handle.

18 Claims, 4 Drawing Sheets

APPARATUS AND METHOD FOR REMOVING A REPLACEABLE HOCKEY STICK BLADE FROM A HANDLE

This application claims the benefit of Provisional application Ser. No. 60/023,448, filed Aug. 22, 1996.

BACKGROUND OF THE INVENTION

1. Field of the Invention

The present invention relates generally to an apparatus and method for pulling or removing a replaceable hockey stick blade, from a handle, and more particularly, to an apparatus and method for removing a replaceable blade from a hockey stick handle or shaft utilizing a conventional door or the like.

2. Description of the Prior Art

Hockey sticks in general, and ice hockey sticks in particular, have experienced dramatic changes throughout the years. As a result, the construction of hockey sticks have evolved substantially. Initially, the handle and blade portions were both constructed of wood and were integrally joined with one another through various processes so that the handle and the blade were essentially a single, integral unit. As technology developed, metal handles constructed of light weight metals such as aluminum, were introduced as a substitute for the traditional wooden handles. These were followed by handles constructed of plastic or composites. Both the metal and plastic or composite handles are used with replacement blades.

The replacement blades typically include a hozzle or tenon end which is insertable into a hollow tenon receiving end of the handle. A heat sensitive adhesive applied between the tenon and the handle is used to secure the blade to the handle. When the blade breaks or becomes worn, it can be replaced. This is accomplished by heating the connection area between the blade and handle and, after the heat sensitive adhesive has softened, pulling the blade connection tenon from the handle. Because there is a relatively tight fit between the exterior surface of the tenon and the interior surface of the hollow handle, significant force often needs to be exerted on the blade in order to remove it from the handle. Accordingly, there is a need in the art for a blade pulling method and apparatus by which a hockey stick handle and replacement blade can be separated when replacement is desired.

SUMMARY OF THE INVENTION

In contrast to the prior art, the present invention provides a unique, quick, safe and efficient apparatus and method for removing or pulling a replaceable blade from a hockey stick shaft. The apparatus of the present invention generally includes a door hook or door attachment portion which is designed for connection to the top edge of a conventional door and a blade pulling portion having a pair of spaced blade support surfaces for supporting or retaining the blade while the hockey stick shaft is being pulled therefrom.

In the preferred embodiment, the door hook or attachment portion comprises a generally inverted "U" shape or "J" shape configuration having a base surface designed for engagement with and positioned adjacent to the top edge of a conventional door and a pair of spaced legs extending from the edges of the base. The legs are parallel to one another, extend from the base at generally right angles and engage opposite side surfaces of the door.

Connected with the door hook portion is a blade pulling portion which includes a pair of spaced blade support surface portions for supporting the blade and resisting movement thereof while a pulling or removing force is exerted on the hockey stick handle. In the preferred embodiment, the blade pulling portion includes a blade pulling recess comprising a support surface for engagement by the blade heel and a support surface for engagement by a top edge portion of the blade. Preferably, the blade pulling portion is spaced outwardly from door hook portion to allow the user's fingers or hands to be positioned between the hockey stick handle and the door surface.

The method aspect of the present invention includes the steps of providing a hockey stick blade pulling apparatus as described above, positioning the apparatus on the top of a door with the door hook portion engaging the top edge and side surfaces of the door. A hockey stick with an attached replaceable blade is then positioned in the blade pulling portion of the device so that the spaced blade support surfaces engage portions of the blade. A downward force is then exerted on the handle to remove the handle from the blade.

For replacement blades which are connected with the handle by heat sensitive adhesives, the method includes the additional step of heating the heat sensitive adhesive in the area of the connection between the blade and the handle prior to inserting the blade into the blade pulling portion.

Accordingly, it is an object of the present invention is to provide a unique method for removing a replaceable hockey stick blade from a hockey stick handle.

Another object of the present invention to provide a hockey stick blade pulling apparatus and method which is quick, safe and efficient.

Another object of the present invention is to provide a device for removing a replaceable blade from a hockey stick shaft by using a conventional door.

These and other objects of the present invention will become apparent with reference to the drawings and the description of the preferred embodiment and method.

DESCRIPTION OF THE PREFERRED EMBODIMENT

Figure 1:
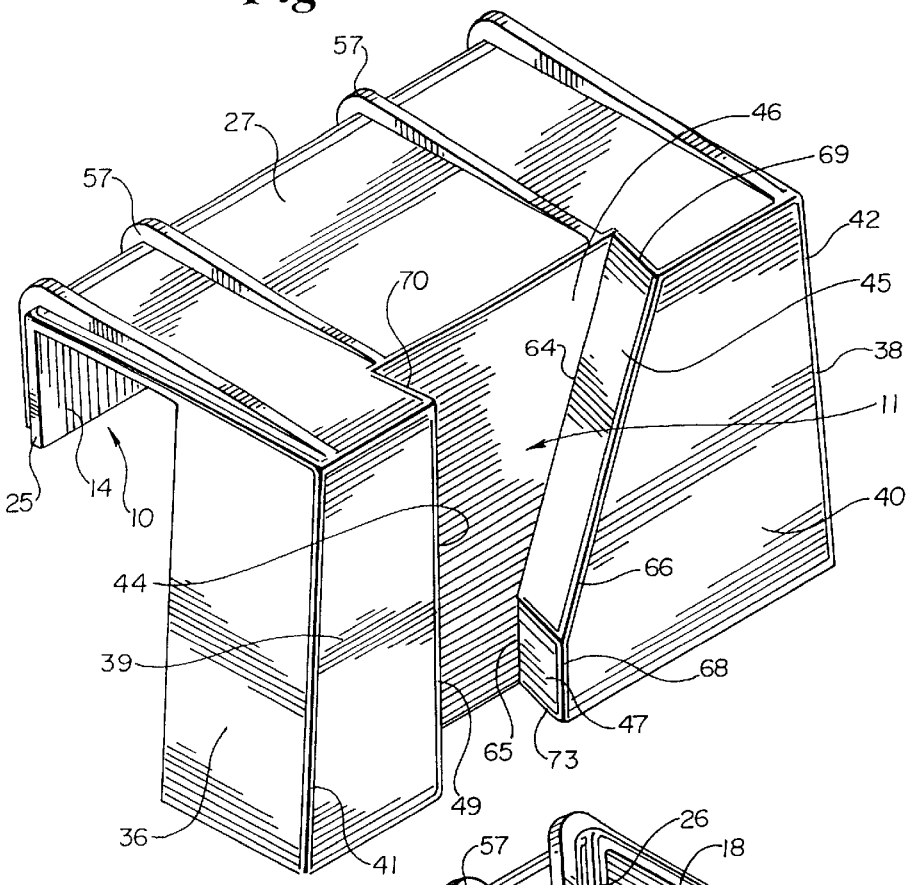
FIG. 1 is an isometric view of the blade pulling apparatus of the present invention showing the top, front and left side.
Figure 2:
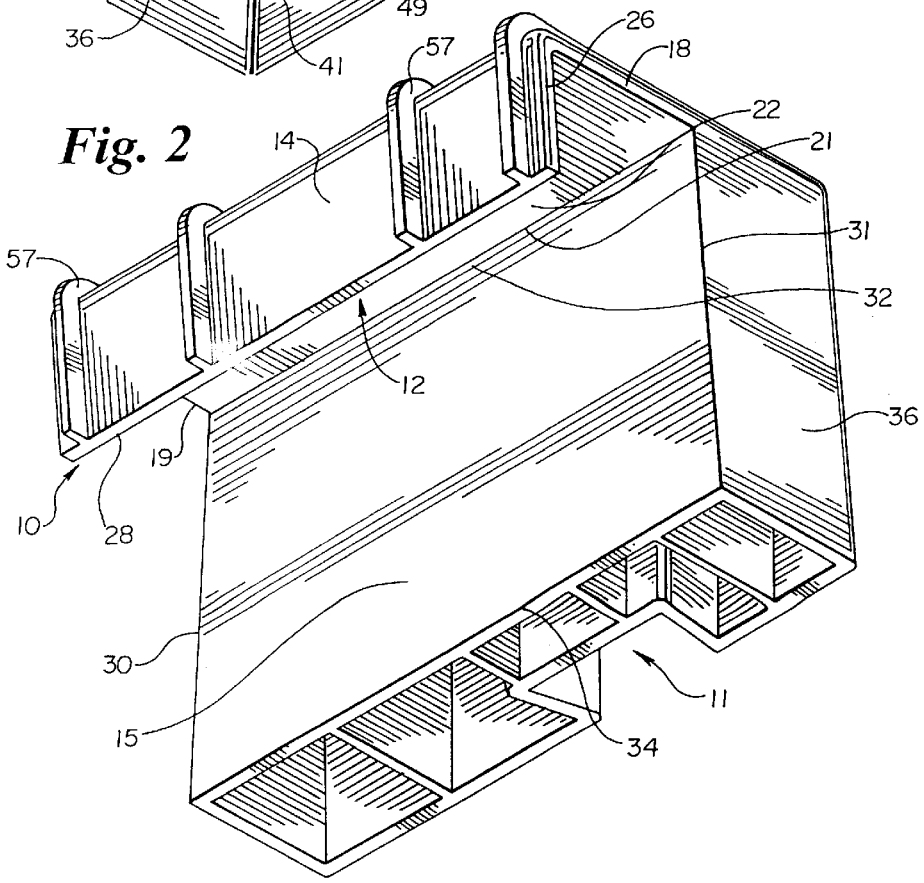
FIG. 2 is an isometric view of the blade pulling apparatus of the present invention showing the bottom, rear and left side.

Initial reference is made to FIGS. 1 and 2 showing front and rear isometric views of the blade pulling apparatus of the present invention. The apparatus includes two primary functional components, a door hook or connection portion 10 and blade support or pulling portion 11. During use, the door hook portion 10 is positioned over the top edge of a conventional door, the blade portion of the hockey stick is positioned in the blade pulling portion 10 and a downward force is exerted on the hockey stick handle to separate the handle from the blade.

Figure 4:
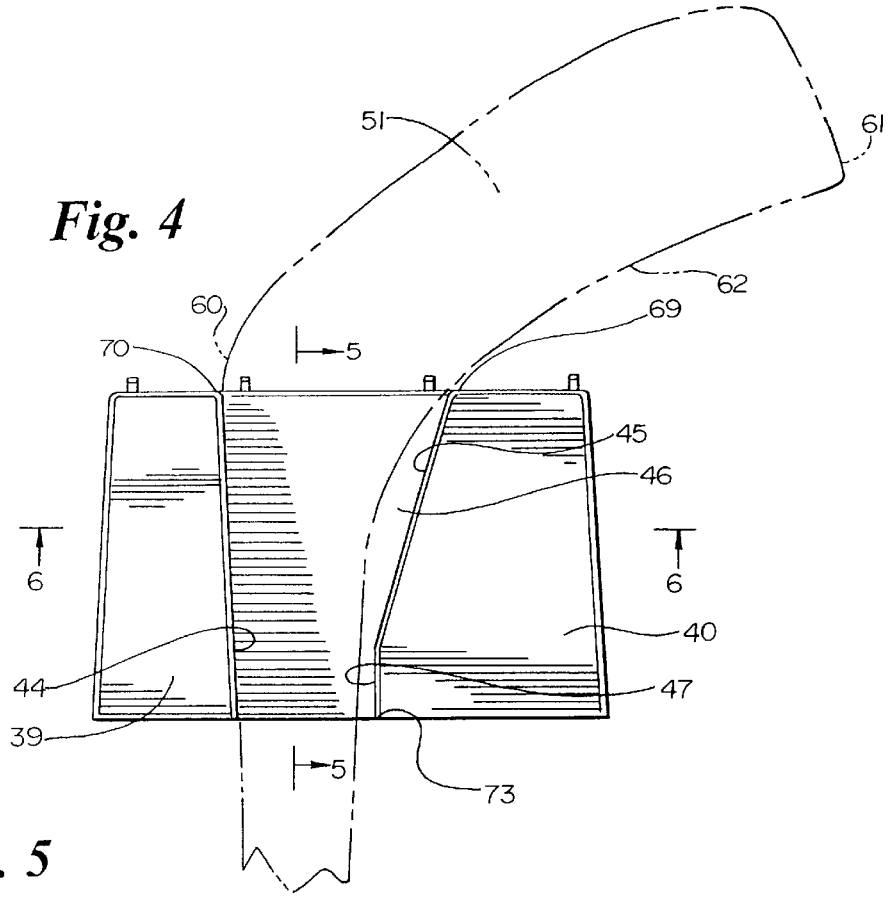
FIG. 4 is a front elevational view of the blade pulling apparatus of the present invention with a hockey stick blade illustrated in phantom.
Figure 5:
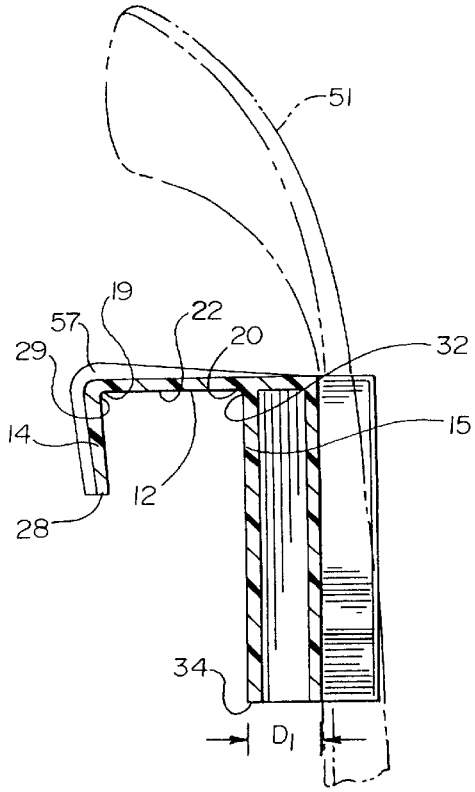
FIG. 5 is a view, partially in section, as viewed along the section line 5—5 of FIG. 4 and showing a hockey stick replacement blade in phantom.
Figure 6:
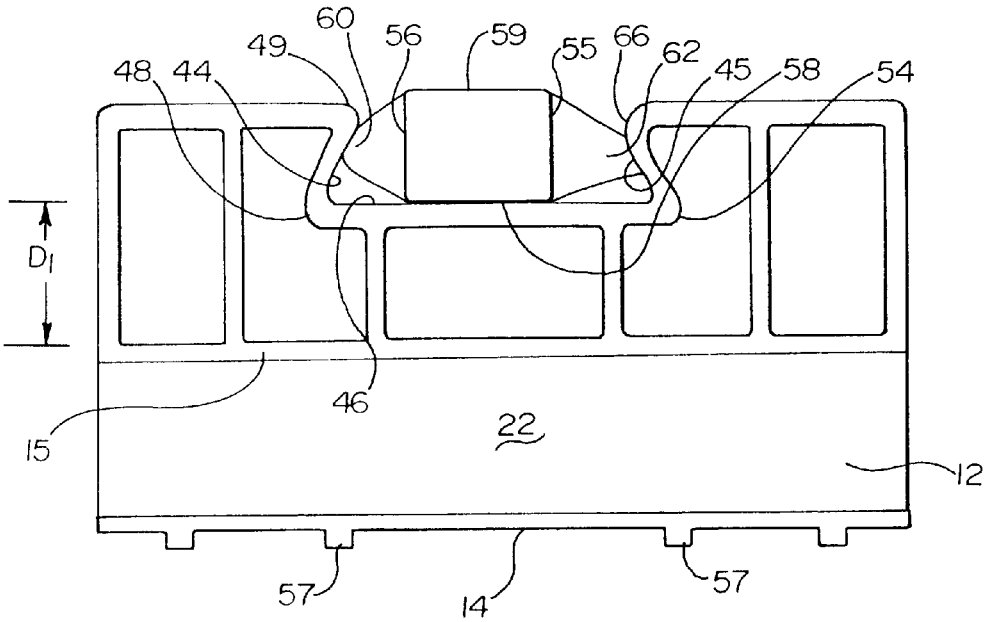
FIG. 6 is a view, partially in section, as viewed along the section line 6—6 of FIG. 4.
Figure 7:
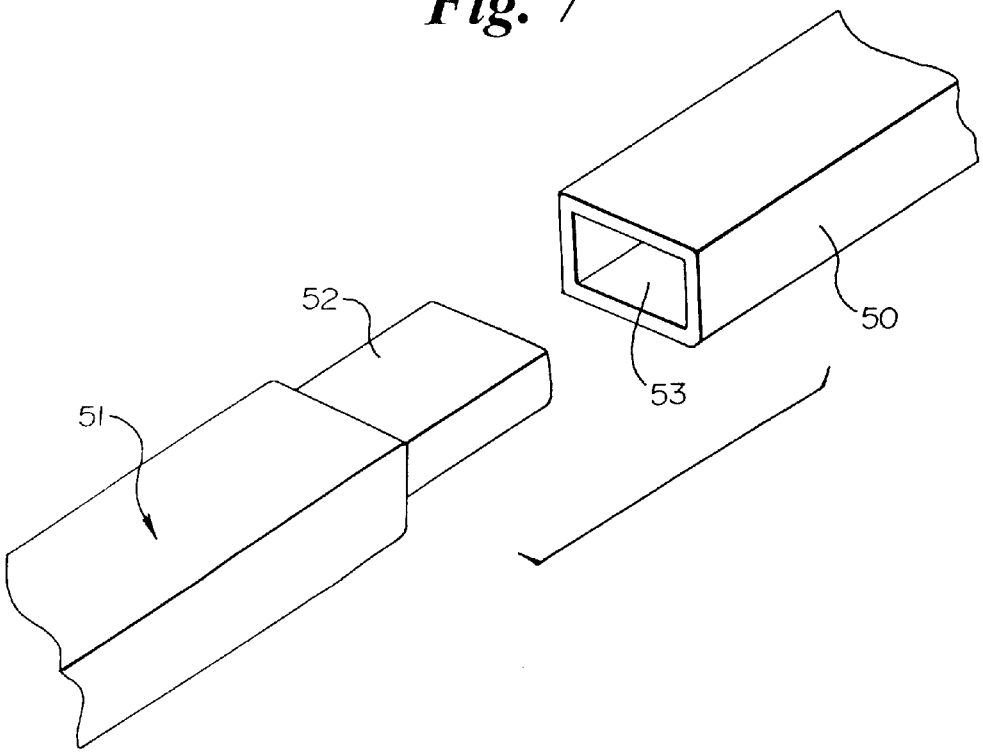
FIG. 7 is an isometric, exploded view showing a portion of a hockey stick handle and replaceable blade.

The apparatus and method of the present invention is designed for use in removing or pulling a replaceable blade from a hockey stick handle or shaft portion. As shown best in FIGS. 3 and 7, such a hockey stick includes a hockey stick handle or shaft 50 commonly constructed of a light weight metal such as aluminum or a plastic or composite material. A replacement blade 51 is connected with the shaft 50 by inserting a tenon 52 of the blade 51 into a hollow blade receiving end 53 of the shaft 50. Conventionally, a heat sensitive adhesive is provided on the tenon 52 so that when inserted into the hollow end 53, the adhesive secures the blade 51 to the handle 50. As illustrated in FIGS. 4, 5 and 6, the blade 51 includes a shaft connecting portion having a top edge 55, a bottom edge 56 and a pair of side edges 58 and 59 and a blade portion having a heel end 60, a free toe end 61 and a top edge 62 extending from the free end 61 to its juncture with the shaft connecting portion.

Figure 3:
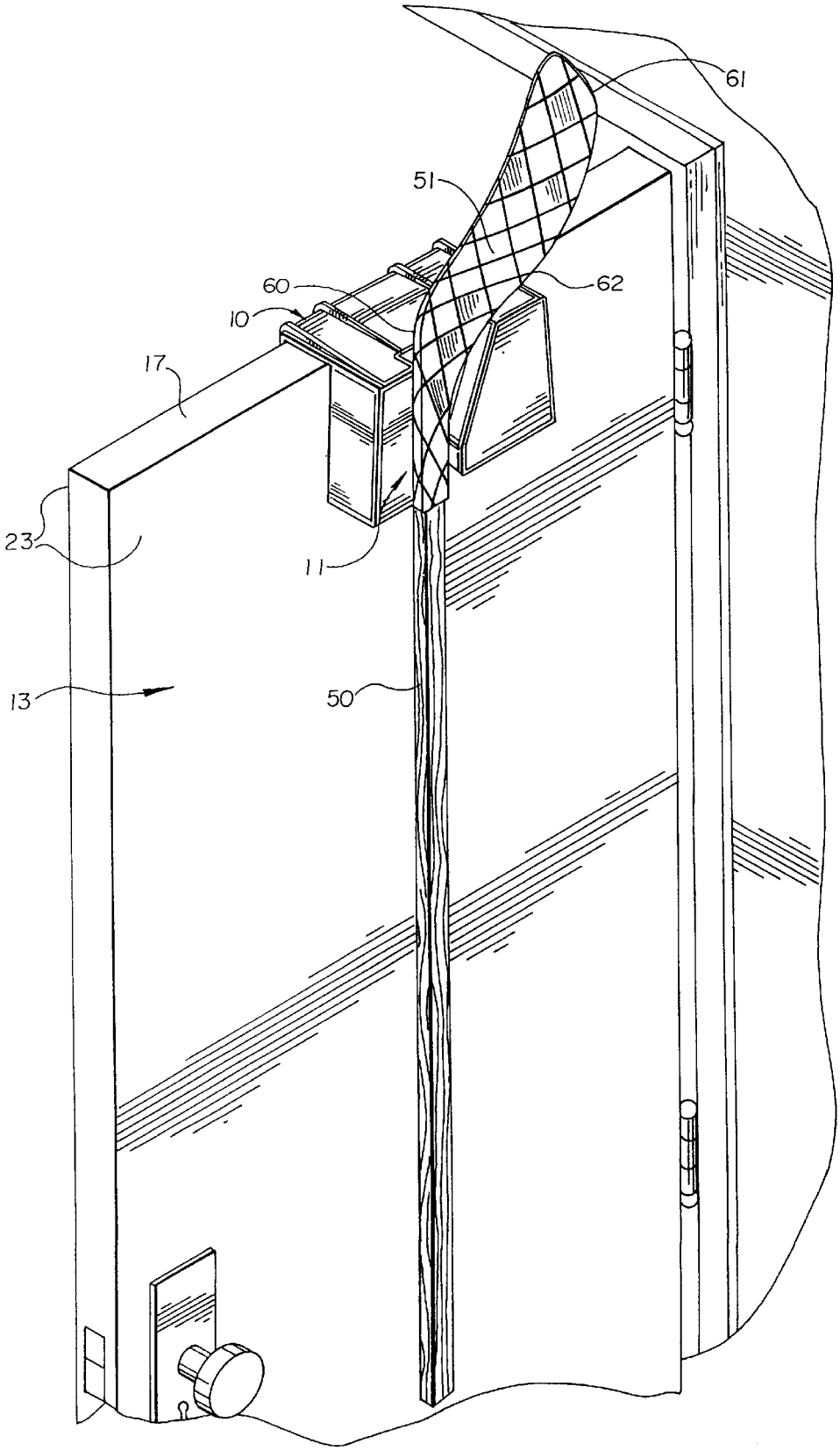
FIG. 3 is an isometric view showing the bade pulling apparatus of the present invention connected with the top edge of a door and the blade and stick in a position for removal.

As shown best in FIG. 3, the apparatus of the present invention is designed for use with a conventional door 13 having a top edge 17 and a pair of side surfaces 23,23.

With specific reference to FIGS. 1, 2 and 5, the door hook portion of the present invention comprises an inverted, generally "U" shaped or "J" shaped configuration having a base 12 and a pair of spaced legs 14 and 15 extending from the base 12. In the preferred embodiment, the base 12 includes a pair of ends 16 and 18 and a pair of spaced side edges 19 and 20. Preferably, the side edges 19 and 20 are parallel to one another and are spaced a distance slightly larger then the thickness of a conventional door (about 1¼" to 1¾") so that the door hook portion can be easily positioned over the top edge 17 of a door. When so positioned, a surface 22 of the base 12 engages the edge 17 of the door. In the preferred embodiment, this surface 22 is a planar surface, however, other surface configurations are possible as long as the base includes at least one door edge engaging surface portion.

The pair of spaced legs 14 and 15 of the door hook portion includes a first or outer leg 14 and a second or inner leg 15. The outer leg 14 includes a pair of side edges 25 and 26, spaced top and bottom edges 28 and 29 and a door side engaging surface 24. As shown best in FIGS. 1, 2 and 5, the edge 29 is integrally joined with the edge 19 of the base and the edge 28 is a free edge generally parallel with the edge 29. If desired the leg 14 may extend from the base 12 at an angle slightly less than 90°.

The inner leg 15 includes a pair of side edges 30 and 31, spaced top and bottom edges 32 and 34 and a door side engaging surface 35. As shown best in FIGS. 2 and 5, the leg 15 is integrally joined with the base 12 so that the edge 32 substantially coincides with the base edge 20. As shown in FIG. 5, the leg 15 extends from the base 20 at approximately right angles. The free bottom edge 34 is parallel to the edge 32. In the preferred embodiment, the length of the leg 15 measured between the edges 32 and 34 is substantially greater than the length of the leg 14 measured between the edges 28 and 29. The door hook portion is provided with a plurality of reinforcing ribs 57.

Joined with the door hook portion 10 is the blade pulling portion 11. In general, the blade pulling portion includes a pair of spaced blade support surface portions for supporting portions of the replaceable blade so that the handle can be removed.

As illustrated best in FIGS. 1, 4 and 5, the blade pulling portion is integrally joined with the door hook portion 10 and includes a pair of side surfaces 36 and 38 extending outwardly from the leg edges 30 and 31 at generally right angles and a front surface comprised of surface portions 39 and 40. The surface 39 joins with the side surface 36 along the corner 51 and the surface 40 joins with the surface 38 along the corner 42.

A blade pulling recess is positioned between the surfaces 39 and 40 and is defined by a recess base 46, a first blade support surface or edge 44 and a second blade support surface or edge defined by the edge portion 45 and 47 for engagement with the blade. As shown in FIGS. 1 and 6, the blade support surface 44 has an inner edge joined with the recess base 46 along the corner 48 and an outer edge joined with the surface 39 along the corner 49. The edge portions 45 and 47 have inner edges which join with the base recess 46 along the corner portions 64 and 65 and outer edges which join with the surface 40 along the corner portions 66 and 68. The blade engaging edges 44, 45 and 47 are substantially planar throughout and, as shown best in FIG. 6, extend outwardly from the surface 46 at an angle slightly less than 90° so that they converge toward one another as they extend outwardly.

As shown in FIG. 4, the blade support edges 44 and 47 are substantially parallel with one another and the support edge 45 is beveled outwardly relative to the edges 44 and 47 as shown. The top end of the support edge 45 joins with the top surface 27 of the apparatus to define a blade support corner 69. The top end of the support edge 44 joins with the top surface 27 of the apparatus to define a blade support corner 70. The bottom end of the support edge 47 joins with the bottom of the apparatus to define the blade support 72.

The recess base 46 comprises a generally planar surface and is preferably spaced outwardly from the inner leg 15 by a distance $D_1$ (FIG. 5) sufficient to enable the user to position his or her fingers around the stick shaft 50 during use. This distance $D_1$ is preferably about ¼" to 2" and more preferably about ¼" to 1".

The apparatus of the present invention is preferably constructed of a structural plastic or composite material, however, it can also be made from a variety of other materials such as lightweight metals or the like. In the preferred embodiment the apparatus is provided along its top and outer edge surfaces by a plurality of reinforcement ribs 57. The interior of the blade pulling portion is provided with a plurality of internal structural reinforcing webs 72 to provide the apparatus with the necessary structural rigidity and support.

To use the apparatus of the present invention in accordance with the present method, the door hook portion 10 is first positioned onto the top edge 17 of a door 13 as shown in FIG. 3. In this position, the base 12 engages the top edge 17 and the legs 14 and 15 engage the sides 23 of the door and extend in the direction of a blade removal force applied to the hockey stick shaft. Next, a hockey stick with a blade which is to be replaced is positioned into the blade pulling portion as shown in FIG. 4. A downward force is then exerted on the handle or shaft 50 until the handle is removed from the blade 51. For blades which are connected to handles by heat sensitive adhesives, the step additionally includes heating the connection between the handle connecting portion 53 and the handle 50 so as to melt or loosen the adhesive. This step is performed prior to placing the blade into the blade pulling portion and exerting the downward force on the handle. Following removal of the blade, the removal tool can be removed from the door, if desired.

As shown best in FIG. 4, when the blade is positioned in the blade pulling portion and a downward force is exerted on the handle, a portion of the top blade edge 62 engages the corner 69, a portion of the blade heel 60 engages the corner 70 and a portion of the front handle connecting portion 55 of the blade engages the corner 73.

Although the description of the preferred embodiment has been quite specific, it is contemplated that various modifications may be made to the description of the preferred embodiment without deviating from the spirit of the present invention.

What is claimed is:

1. A replacement blade removal tool adapted for use in removing a replacement blade from a hockey stick shaft and in which said hockey stick replacement blade includes a first edge portion comprised of a front edge of a blade shaft section and a top edge of the blade, a second edge portion comprised of a back edge of the blade shaft section and a bottom edge of the blade and a shaft section dimension defined by the distance between the front and back edges of the shaft section, said removal tool comprising:

a U-shaped, door edge engaging portion configured to matingly receive a door edge adapted to be positioned over the edge of a door and, when so positioned adapted to resist a blade removal force in a first direction against said edge;

a blade pulling portion connected with said door edge engaging portion, said blade pulling portion including first and second blade engaging surfaces said blade engaging surfaces being spaced from one another a distance greater than said shaft section dimension and being adapted to receive a portion of the replacement blade between said first and-second blade engaging surfaces;

said first blade engaging surface adapted to engage the first edge portion of the replacement blade; and, said second blade engaging surface adapted to engage the second edge portion of the replacement blade whereby said first and second blade engaging surfaces are adapted to engage said first and second edge portions of the replacement blade to resist a blade removal fore and whereby a force exerted on said shaft in a first direction, with first and second blade engaging surfaces engaging said first and second edge portions of the replacement blade, causes removal of said blade from said shaft.

2. The replacement blade removal tool of claim 1 wherein said door edge engaging portion includes a base and first and second legs extending from said base in a first direction.

3. The replacement blade removal tool of claim 1 wherein said door edge engaging portion includes a blade removal force surface facing in a first direction.

4. The replacement blade removal tool of claim 3 whereby said first and second blade engaging surfaces engage said first and second edge portions of the replacement blade to resist a blade removal force in said first direction.

5. The replacement blade removal tool of claim 1 wherein said blade pulling portion includes a blade pulling recess defined by said first and second blade engaging surfaces.

6. The replacement blade removal tool of claim 1 including a central section with opposing sides wherein said door engaging portion is positioned on one side of said central section and said blade portion is positioned on the opposing side of said central section.

7. The replacement blade removal tool of claim 1 wherein said door engaging U-shaped portion is defined by a base and a pair of spaced legs and wherein said central section includes a wall forming one of said legs.

8. The replacement blade removal tool of claim 7 wherein said legs extend from said base in a first direction.

9. The replacement blade removal tool of claim 8 wherein said blade pulling portion includes a blade pulling recess defined by said first and second blade engaging surfaces.

10. The replacement blade removal tool of claim 9 wherein said blade pulling recess is a blade receiving recess.

11. The replacement blade removal tool of claim 10 whereby said first and second blade engaging surfaces are adapted to engage said first and second edge portions of the replacement blade to resist a blade removal force in said first direction when said blade is received by said blade receiving recess.

12. The replacement blade removal tool of claim 11 wherein said blade receiving recess includes a recess base generally parallel to said wall.

13. The replacement blade removal tool of claim 12 wherein said blade engaging surfaces extend outwardly from said recess base.

14. The replacement blade removal tool of claim 13 wherein said blade engaging surfaces extend outwardly from said recess base at angles which converge toward one another as said blade engaging surfaces extend outwardly.

15. The replacement blade removal tool of claim 13 wherein said recess base is spaced from said wall a distance of at least one quarter inch.

16. A method of removing a replacement bade from a hockey stick shaft comprising the steps of:

providing a replacement blade removal tool having a door engaging portion and a connected blade pulling portion with a pair of spaced blade engaging surfaces;

positioning said removal tool on a door edge so that said door engaging portion engages the edge of a door and resists a force in a first direction;

positioning the hockey stick shaft with a connected replacement blade so that opposing edges of said replacement blade are engaged by said pair of blade engaging surfaces;

exerting a blade removal force on said hockey stick shaft in said first direction until said replacement blade is removed from said shaft.

17. The method of claim 16 including removing said removal tool from said door edge after said replacement blade has been removed from said shaft.

18. The method of claim 16 including heating the connection area between said replacement blade and said shaft prior to said hockey stick and replacement blade positioning step.

* * * * *